United States Patent [19]

Gannon

[11] 4,000,527

[45] Jan. 4, 1977

[54] SWIMMING POOL COVER FLOATING SUPPORT

[75] Inventor: Peter F. Gannon, Sterling Heights, Mich.

[73] Assignee: Vinyl-Fab Industries, Inc., Ferndale, Mich.

[22] Filed: Aug. 26, 1975

[21] Appl. No.: 607,767

[52] U.S. Cl. ..... 4/172.12

[51] Int. Cl.[2] ..... E04H 3/16; E04H 3/18

[58] Field of Search ..... 4/172, 172.11, 172.12, 4/172.13, 172.14

[56] References Cited

UNITED STATES PATENTS

| | | | |
|---|---|---|---|
| 3,000,017 | 9/1961 | Skovira | 4/172.13 |
| 3,091,777 | 6/1963 | Pearlson | 4/172.13 |
| 3,366,977 | 2/1968 | Koehler | 4/172.12 |
| 3,423,768 | 1/1969 | Glenn | 4/172.13 |
| 3,600,721 | 8/1971 | Pusey | 4/172.12 |
| 3,813,704 | 6/1974 | Troiano | 4/172.13 |
| 3,871,033 | 3/1975 | Bartlett | 4/172.13 |

*Primary Examiner*—Henry K. Artis
*Attorney, Agent, or Firm*—Hauke & Patalidis

[57] ABSTRACT

A swimming pool cover support frame comprising a plurality of elongated floating elements such as inflated tube sections which are fastened together pivotally and removably at their juxtaposed ends, and which are removably attached to the pool edge at their other ends.

6 Claims, 7 Drawing Figures

SWIMMING POOL COVER FLOATING SUPPORT

BACKGROUND OF THE INVENTION

The present invention relates to floating supporting means for swimming pool covers. Swimming pool covers are widely used by owners of outdoor pools to shield the pool from dirt, debris and the elements during such times when the pools are not in use. The obvious advantages of protecting the water in the pool by covering it are often frustrated by dirt, debris and rain water collecting at the unsupported center of the pool cover causing the cover to sag at the center. When this occurs, it is quite difficult to remove the cover from the pool because of the weight of the debris and more particularly the collected water, without allowing the undesirable dirt particles, objects, or water to fall in. Another problem associated with unsupported pool covers is wind flapping of a side of the cover which is caused by the migration of collected water to a corner of the cover causing in turn uneven loading of the cover.

Supporting means for swimming pool covers found in the prior art generally comprise large, center mounted floats. Many disadvantages have been experienced in connection with such a type of pool cover support means, for example, stress and susceptibility to heat build up of the large volume of air trapped below the cover, causing excessive heat deterioration of the pool cover. Another disadvantage experienced with center supported pool covers is their inability to be adequately supported when the pool is kidney-shaped or has some other asymmetrical shape. Failure or deflation of a large center mounted support float results in the entire defeat of the pool cover support system and the collapse of the pool cover into the pool.

SUMMARY OF THE INVENTION

The pool cover support floating frame of the present invention generally comprises a plurality of elongated floating elements which are pivotally and removably joined together by fastening means provided at each end. The floating elements, preferably inflatable tubes, may be produced in various sizes and arranged in any appropriate manner to provide a pool cover supporting framework which will conform to irregularly shaped pools. The use of a plurality of floating elements insures that the entire pool cover supporting system will withstand the puncture, failure or deflation of one or more of the floating elements, thus providing a highly desirable margin of safety. Furthermore, the individual floating elements forming the support framework of the present invention being preferably of a tapered shape with their relatively larger diameter located at the central portion of the framework, the resulting edgewise directed slope of the supported cover causes rain water, dirt and other debris falling on the cover to collect at the outer edge of the pool cover, rather than at its center thus providing for easy cleaning and the safe and easy removal of the pool cover. The pool cover supporting means of the present invention thus overcomes the disadvantages of the prior art.

Other objects and advantages of the present invention will become apparent to those skilled in the art when the following detailed description of the present invention is read in conjunction with the accompanying drawings wherein like reference characters refer to like parts throughout the several views and in which:

DESCRIPTION OF THE PREFERRED EMBODIMENTS

Figure 1:
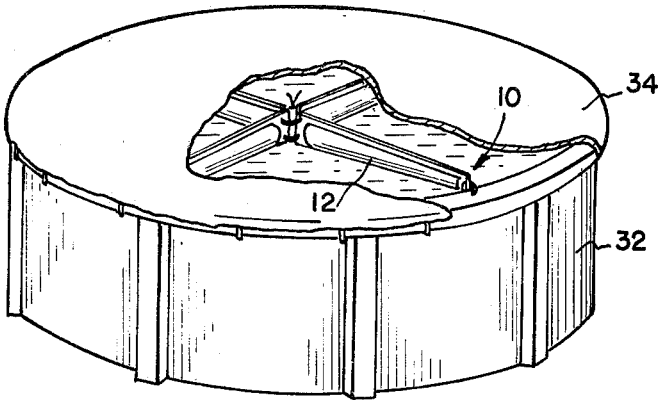
FIG. 1 is a perspective view, partly in section, of an above-the-ground pool provided with a cover supported by a floating framework according to the present invention.
Figure 3:
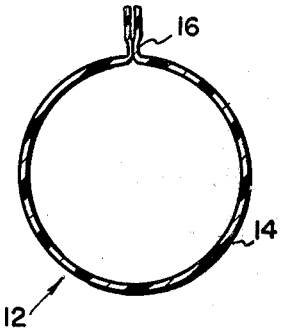
FIG. 3 is a cross section view taken substantially along line 3—3 of FIG. 2.
Figure 2:
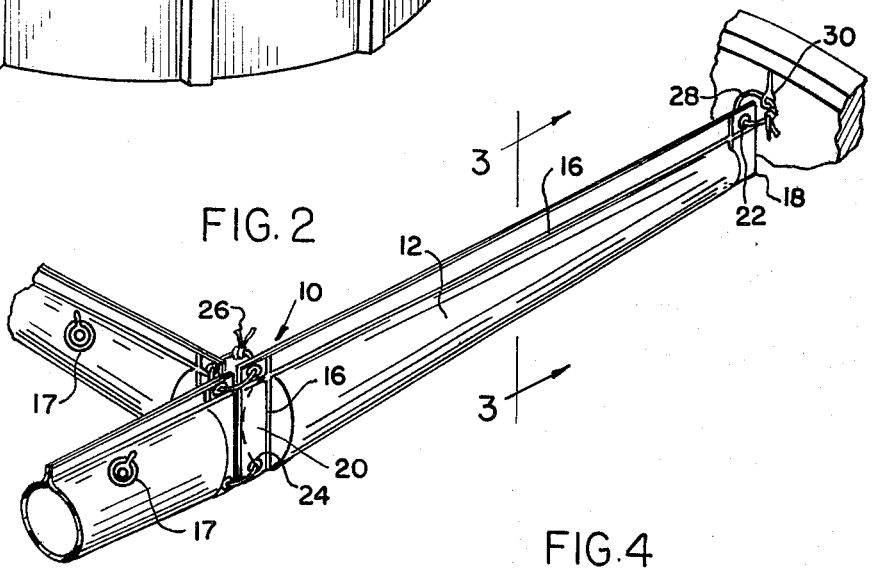
FIG. 2 is a perspective detailed partial view of an example of pool cover support framework according to the present invention.
Figure 5:
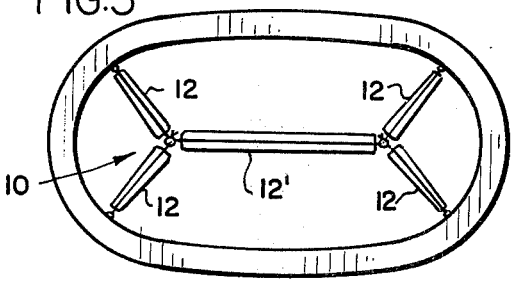
FIG. 5 is a schematic top plan view of a pool cover support framework according to the present invention for supporting the cover of an oval shaped pool.

Referring now to FIGS. 1–3, a swimming pool cover supporting framework 10 according to the present invention comprises generally a plurality of individual floating elements 12, which may be made of foam plastic, hollow plastic moldings, or like construction, but which are made preferably of air inflated tubular bladders. In the structure illustrated, the individual floating elements 12 are integrally formed from a single piece of water and air impervious material 14 heat-sealed along its length and at both ends, as shown at 16. An example of suitable material for making the tubular bladders 12 is inflatable grade PVC (polyvinylchloride) of about 11 mil thickness, for example, and is provided, as best shown at FIG. 2, with an appropriate valve 17 for inflation, such as for example the flap valve sold on the market under the trademark "Roberts". Preferably, the valve 17 is of the type permitting mouth inflation of the tubular bladder 12. Each end of each individual tubular bladder 12 has a flap, shown respectively at 18 and 20, formed by the double thickness of material 14, the end flap 18 being provided with at least one metallic eyelet 22 and the other end flap 20 being provided with at least one and preferably a pair of metallic eyelets 24. A plurality of individual tubular bladders 12 are tied together by way of a string 26, or other appropriate fastening means laced through the eyelets 24, such as to form the floating frame 10. A ring or string 28 is passed through the eyelet 22 at the end flap 18 of each tubular bladder 12 for attachment to a ring 30 at the edge of the pool. Preferably, the tubular bladder 12, when inflated, provides a tapered shape of decreasing diameter from the end flap 20 to the end flap 18 attached to the edge of the pool. In this manner, when the cover support framework 10 is disposed floating on the surface of the water in a pool, such as the circular shaped above-the-ground pool 32 of FIG. 1, and a pool cover 34 is placed on the top of the framework and properly attached to the edge of the pool, there results an appropriate slope from the center to the edge of the cover allowing rain water and other debris to drain off or accumulate relatively close to the edge of the pool to facilitate cleaning of the cover. For eight-foot long, for example, individual air inflatable bladder 12, an appropriate taper may consist of forming the bladder with an outer diameter of 18 inches, for example, at its larger end tapering down to 6 inches, for example, at its smaller diameter end.

Figure 4:
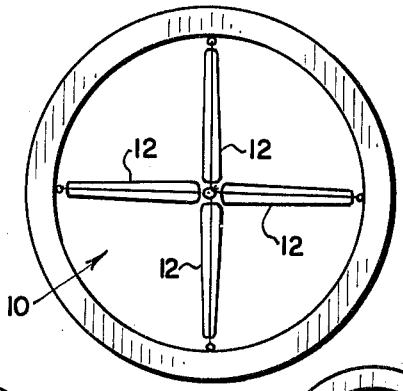
FIG. 4 is a schematic top plan view of a pool cover support framework for a circularly shaped pool.

As illustrated at FIGS. 1 and 4, four individual floating bladders 12, joined together at their ends as hereinbefore explained and as illustrated at FIG. 2, with their smaller diameter ends attached to the edge of the pool, are sufficient to support a cover. If desired, more individual floating elements may be used.

Figure 6:
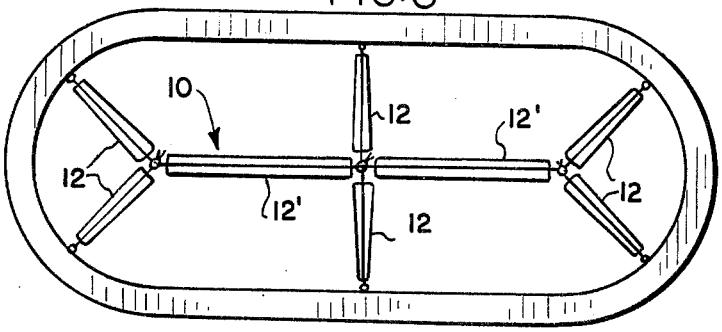
FIG. 6 is a schematic top plan view of a pool cover support framework according to the present invention for supporting the cover of a rectangular shaped pool.

FIG. 6 schematically illustrates a framework 10 for an oval-shaped pool, consisting of a relatively large diameter cylindrical inflated tubular bladder 12′, to each end of which is attached a pair of tapered inflated tubular bladders 12, having their smaller diameter ends attached to the edge of the pool and arranged symmetrically such that the tapered bladders 12 are disposed approximately at a right angle to each other.

FIG. 6 illustrates an arrangement for a swimming pool cover supporting framework 10 according to the present invention, for a large size oval pool or for a rectangular shaped pool, consisting of a pair of straight cylindrical inflated bladders 12′ attached end to end along the longitudinal axis of the pool, and a pair of tapered tubular bladders 12 attached at the junction between the two cylindrical bladders 12′ each of the cylindrical tubular bladders 12′ being provided at its free end with a pair of tapered bladders 12.

Figure 7:
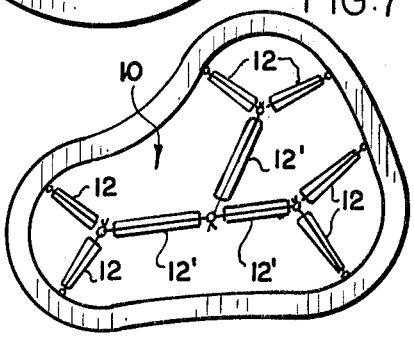
FIG. 7 is a schematic top plan view of a pool cover support framework according to the present invention for supporting the cover of a kidney-shaped pool.

FIG. 7 illustrates an example of a swimming pool cover supporting framework 10 according to the present invention, as used for supporting the cover of an irregularly-shaped pool, such as a kidney-shaped pool. In the example illustrated, the framework 10 consists of three cylindrical tubular members 12′ and three pair of tapered members 12 so as to provide an appropriate slope for the swimming pool cover.

It can be seen that by means of the present invention, floating framework for supporting swimming pool covers of any shape and any dimension whatsoever can be made by attaching together any number of floating tubular elements so as to form an appropriately shaped framework for supporting a swimming pool cover, the cover being provided, when in place over the pool, with an appropriate slope from substantially the center thereof to the edge.

Having thus described the present invention by way of typical examples of practical structures, modifications whereof will be apparent to those skilled in the art, what is claimed as novel is as follows:

I claim:

1. A swimming pool cover support floating frame comprising a plurality of separate elongated floating elements disposed below said cover and fastening means at each end of said elongated floating elements for pivotally and removably attaching juxtaposed ends of at least two of said elongated floating elements together and for attaching each free end of said elongated floating elements proximate the edge of the pool, some of said elongated floating elements extending from proximate the edge of the pool towards the center of said pool.

2. The frame of claim 1 wherein each of said floating elements is made of an air-inflated tubular bladder having an individual air inflating valve.

3. The frame of claim 2 wherein each said air-inflated tubular bladder is integrally formed from a single piece of air impervious material sealed at each end and along its edge lengthwise.

4. The frame of claim 2 wherein said fastening means comprises at least one eyelet at each end of said bladders.

5. The frame of claim 4 wherein said connecting means joining a plurality of said separate air inflated tubular bladders is string laced through said eyelets at the juxtaposed ends thereof.

6. The frame of claim 1 wherein at least one of said elongated floating elements is tapered from end to end and is arranged in such a manner that its end of larger diameter is located proximate the center of the pool for raising the center of a pool cover relative to the edge thereof when covering said pool.

* * * * *